US005816856A

United States Patent [19]

Kamath et al.

[11] Patent Number: 5,816,856

[45] Date of Patent: Oct. 6, 1998

[54] APPARATUS FOR DETECTING AND LOCKING ELECTRICAL CONNECTOR TERMINALS

[75] Inventors: Shashidhar M. Kamath, Belleville, Mich.; Seiji Kozono, Shizuoka, Japan

[73] Assignee: Yazaki Corporation, Tokyo, Japan

[21] Appl. No.: 778,490

[22] Filed: Jan. 3, 1997

[51] Int. Cl.[6] ..... H01R 13/40

[52] U.S. Cl. ..... 439/595

[58] Field of Search ..... 439/595, 752, 439/597, 598, 599, 600, 594, 733, 744, 745

[56] References Cited

U.S. PATENT DOCUMENTS

| | | | |
|---|---|---|---|
| 4,944,695 | 7/1990 | Tsuji et al. | 439/595 |
| 4,944,696 | 7/1990 | Sueyoshi et al. | 439/595 |
| 5,088,938 | 2/1992 | Murakami et al. | 439/595 |
| 5,127,847 | 7/1992 | Kato et al. | 439/489 |
| 5,256,084 | 10/1993 | Kodama | 439/595 |
| 5,322,456 | 6/1994 | Yagi et al. | 439/595 |
| 5,607,327 | 3/1997 | Tsuji et al. | 439/595 |
| 5,713,761 | 2/1998 | Okayasu | 439/595 |

*Primary Examiner*—Gary F. Paumen
*Assistant Examiner*—Yong Kim
*Attorney, Agent, or Firm*—Young & Basile, P.C.

[57] ABSTRACT

A spacer for an electrical connector which detects the presence of electrical terminals inserted into terminal accommodating chambers in the connector and which locks the terminals in the chambers only when the terminals are fully inserted. The spacer preferably has a lock arm for each chamber. Each lock arm has a stop which holds the spacer in a pre-set position by abutting against the chamber. As the terminal is inserted into the chamber, the terminal contacts the lock arm and deflects it to a position where the stop no longer engages the chamber. The spacer can only be moved to a full-lock position when all terminals are completely inserted into the chambers. Each lock arm preferably includes a terminal-detecting projection which rides along a surface of the terminal until it reaches an engagement aperture in the surface of the terminal. The projection is then securely received by the engagement aperture as the lock arm returns to an at rest position.

19 Claims, 3 Drawing Sheets

APPARATUS FOR DETECTING AND LOCKING ELECTRICAL CONNECTOR TERMINALS

FIELD OF THE INVENTION

This invention relates to spacers for electrical connectors, and more particularly to a spacer which cannot be moved to a position locking an electrical terminal in an electrical connector until the spacer detects that the terminal is completely inserted in the connector.

DISCUSSION OF PRIOR ART

Generally, modular electrical connector housings of the type used in the automotive industry receive multiple pre-wired electrical terminals in terminal accommodating chambers in the housing. A flexible retainer arm in each chamber locks the terminal in the housing when the terminal is inserted in the chamber. The flexible retainer arm prevents the terminal from being accidentally removed from the connector or shifted from the fully inserted position. But the retainer arm can be inadvertently deflected out of engagement with the terminal, or can be broken.

Spacers are often used in such connectors to reinforce the lock on the terminals. A spacer is usually a plug- or plate-shaped piece inserted into the connector housing from the side opposite the terminal openings, assisting the flexible retainer arm already in the housing to lock the terminal in place.

There are generally two common types of spacers: those which must be removed and installed each time the terminals are inserted, and those which are pre-set in the connector housing. Pre-set spacers usually have a latching pawl on an insertion end of the spacer which mates with a recess in a wall of the terminal accommodating chamber to prevent the spacer from falling out of the connector.

While pre-set spacers offer simplified assembly, they can be inadvertently pushed into a premature full-lock position during shipping and handling, forcing the assembler to first unlock and remove the spacer before inserting terminals into the connector housing. This slows assembly and many assemblers have difficulty removing the spacer from the locked position.

U.S. Pat. No. 5,176,537 discloses a spacer ("reinforcement member") with a pre-set position and a full-lock position. A flexible retainer arm projects from the inner wall of a terminal accommodating chamber in the connector housing. In the full-lock position the spacer holds the retainer arm in engagement with a retaining hole in the terminal. The spacer does not have a terminal detection feature. Insertion force needed to move the member from the pre-set position to the full-lock position is low, and the likelihood of premature full insertion is high. Furthermore, the spacer does not provide a terminal locking feature independently of the retainer arm in the connector housing.

U.S. Pat. No. 5,088,938 sets forth a spacer ("terminal locking block") which is held in a pre-set position within a connector housing by locking claws which engage the side walls separating the terminal accommodating chambers. When a terminal is inserted in a chamber, the block is pushed backward partway out of the housing and released from the pre-set position. The block must then be pushed back in to the fully inserted position so that projections on the spacer engage a hole in the terminal to further lock the terminal within the housing. This type of locking feature is complex in structure and would increase manufacturing costs. It does not provide a stable pre-set position, and the block may be pushed out of the way by one terminal regardless of whether the other terminal is fully inserted in a chamber. Furthermore, the terminal detection feature requires the release of the block from the pre-set position (as described above), and relies on the flexible retainer arm to properly position the terminal upwardly with room underneath for the block.

SUMMARY OF THE INVENTION

Accordingly, it is an object of this invention to provide an improved pre-set spacer for the connector housing and to simultaneously prevent accidental insertion of the spacer from the pre-set to full-lock position during shipping and handling.

It is another object of this invention to provide a spacer with a terminal detection feature which prevents accidental locking of the spacer prior to the terminal being fully inserted in the housing.

A further object of this invention is to provide a spacer which locks directly onto the fully inserted terminal to aid in retaining the terminal in the housing.

In carrying out this invention in the illustrative embodiment thereof, the invention provides a pre-set spacer in which the terminal detection feature involves deflection of a portion of the spacer rather than the terminal or internal retainer arm. The spacer also remains firmly locked in the pre-set position while the terminal is inserted and this passive, terminal-initiated terminal detection feature is activated. Accidental insertion of the spacer from pre-set to full-lock is positively prevented by passive ineraction between the spacer and a fixed wall of the terminal accommodating chamber rather than between the spacer and the terminal or the internal terminal retainer arm.

When a terminal is fully inserted in the terminal accommodating chamber, a flexible lock arm in the pre-set spacer is deflected sufficiently to clear a wall of the chamber. With the lock arm thus deflected, the spacer can be pushed into a full-lock position securing the terminal in the chamber. Although the spacer can be provided with structure to enhance the locking force of the retainer arm on the terminal, a preferred feature on the lock arm allows the spacer to lock directly onto the terminal.

BRIEF DESCRIPTION OF THE DRAWINGS

This invention will be more clearly understood from the description of the illustrated embodiment set forth in the following drawings.

DESCRIPTION OF THE ILLUSTRATED EMBODIMENT

Figure 1:
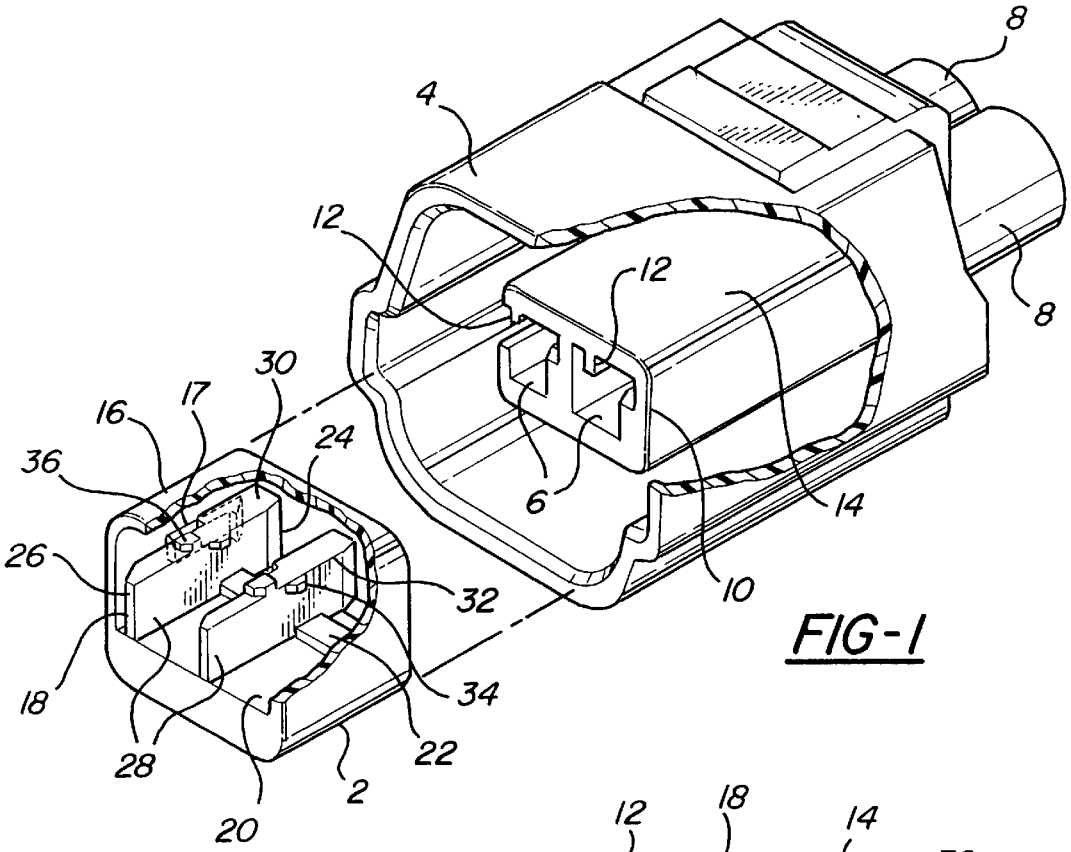
FIG. 1 is a perspective cutaway view of an electrical connector with a disengaged spacer according to the present invention.

Referring now to FIG. 1, a spacer 2 according to the present invention is shown with a conventional electrical connector housing 4. The connector 4 has electrical terminal accommodating chambers 6. Each terminal accommodating chamber 6 receives a terminal (not shown) through a first end 8 of the chamber 6 opposite the spacer 2. When fully inserted in chamber 6, the terminals are positioned to make electrical contact with terminals in another mating connector (not shown) mated through spacer 2 to second end 10 of each chamber 6 to complete an electrical connection in known fashion. A wall or wall extension 12 extends into each chamber 6 from a top section of the outer wall 14 of chamber 6.

The spacer 2 of this invention is formed from a synthetic resin. The spacer 2 comprises an outer housing 16 with inner lock arms 18. The lock arms 18 are elongated members and are connected to the housing 16 by a raised cross arm 22 integral with the bottom wall 20 of housing 16. The lock arms 18 are tapered in cross-section from front to rear so that they are flexible and may be deflected longitudinally from the at-rest position shown in FIG. 1 as if hinged to the spacer housing at cross arm 22.

Before connector 4 is actually put into use, it is typically pre-assembled with spacer 2 for shipping to the assembly location. This preassembly involves pushing spacer 2 into a "pre-set" position in the connector from which it is prevented from falling out of the connector during shipping and handling, and from which it is further capable of being pushed into a "full-lock" position engaging chambers 6 and the terminals inside. For example, spacer 2 can be held in its pre-set position by means of a conventional latching pawl 17 extending from its inner side wall to mate with a recess in a side wall of the terminal accommodating chamber 6. Other examples of such conventional latching pawl structure are described in U.S. Pat. Nos. 5,176,537 and 5,088,938 (mentioned above in the "Background").

Figure 3:
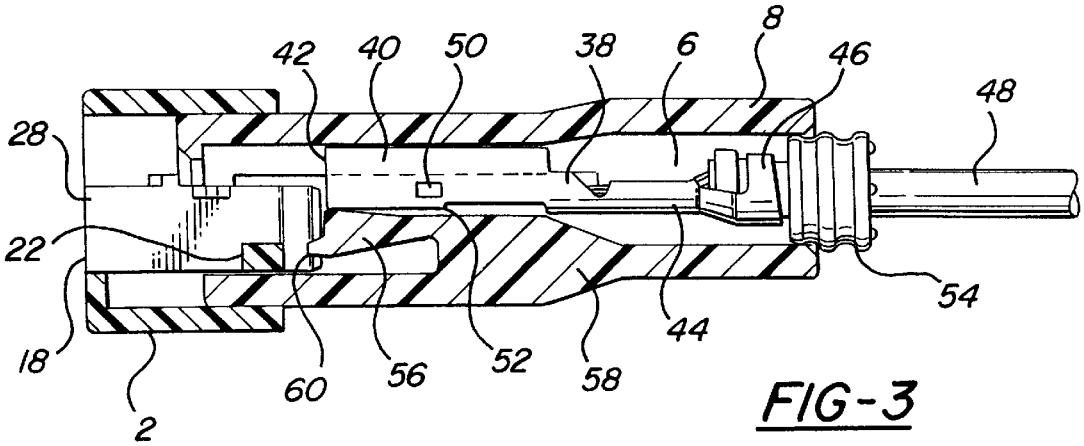
FIG. 3 is a cross-sectional side view (relative to FIG. 1) of the chamber and terminal with the spacer and lock arm in the position shown in FIG. 2.
Figure 5:
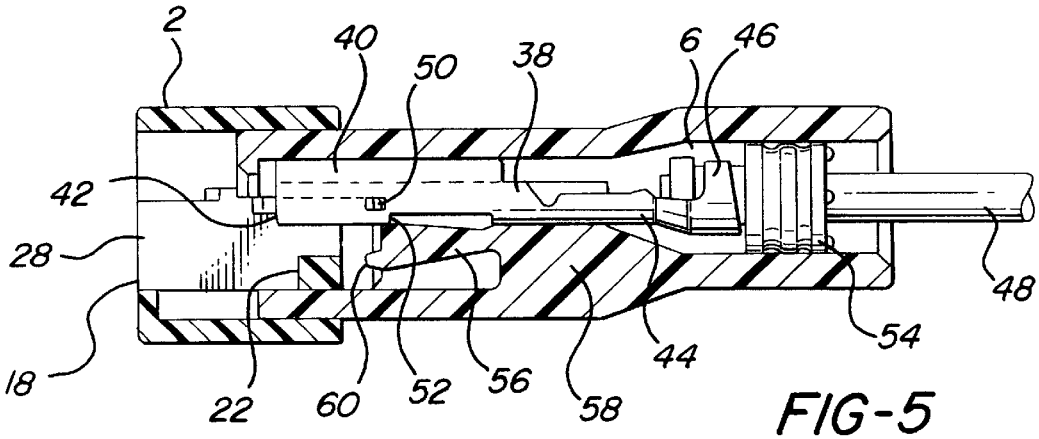
FIG. 5 is a cross-sectional side view (relative to FIG. 1) of the chamber and terminal with the spacer and lock arm in the position shown in FIG. 4.
Figure 7:
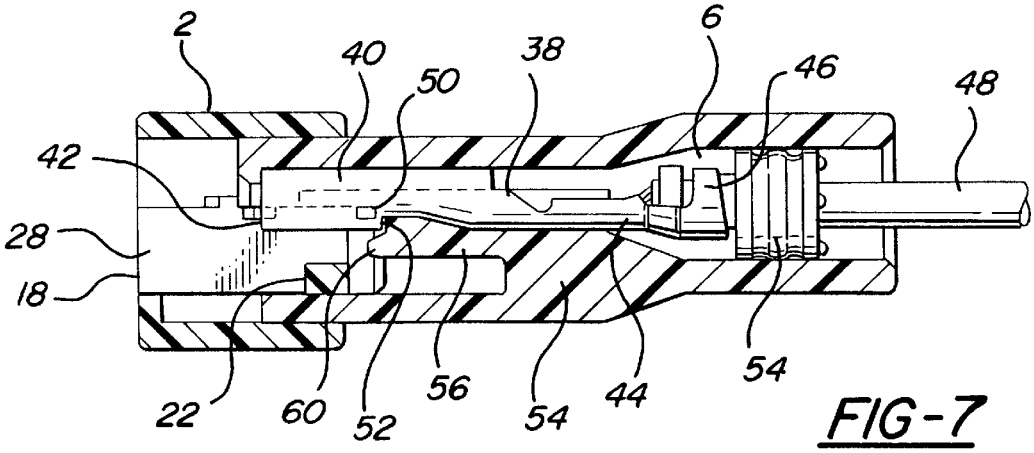
FIG. 7 is a cross-sectional side view (relative to FIG. 1) of the chamber and terminal with the spacer and lock arm in the position shown in FIG. 6.

Each lock arm 18 in spacer 2 has an insert end 24 and a deflector end 26. Lock arms 18 are at least partway inside chambers 6 in the pre-set position, as best shown in FIGS. 3, 5 and 7. Side wall 28 of each lock arm 18 faces a terminal inserted in chamber 6. Each lock arm 18 also has a top edge 30 which faces extension 12 in chamber 6 when spacer 2 is inserted into connector 4. Top edge 30 of the lock arm 18 joins or meets the sidewall 28 of the lock arm 18 at an edge 32 and is substantially perpendicular to side 28.

Intermediate the insert end 24 and the deflector end 26 of the lock arm 18 is a chamfered terminal-locking projection 34 on side wall 28 adjacent upper edge 32. An insertion-blocking stop 36 is formed on top surface 30. Stop 36 is also adjacent upper edge 32 but is spaced rearwardly from terminal-locking projection 34 toward deflector end 26 of lock arm 18.

FIGS. 2–11 illustrate the operation of spacer 2 from pre-set to full-lock positions. For clarity, only one lock arm 18 and one terminal accommodating chamber 6 are illustrated. However, the invention can be used with electrical connectors having any number of terminal accommodating chambers. The size of spacer 2 and the number of lock arms 18 depend on the number of chambers 6 in the connector 4. A lock arm 18 is preferably provided for each chamber 6. In spacers with multiple terminal accommodating chambers and lock arms, every corresponding terminal must be fully inserted in every chamber receiving a lock arm before the spacer can be moved to the full-lock position.

Figure 2:
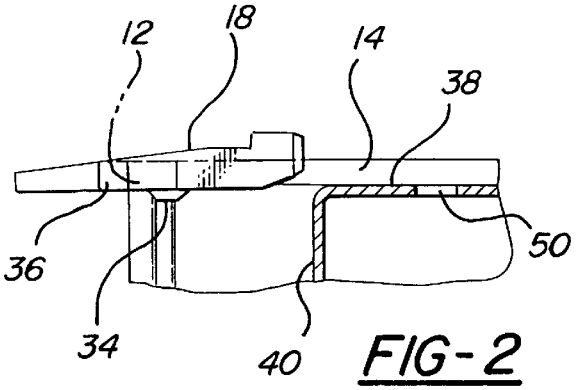
FIG. 2 is a partial cross-sectional top view of the left-side terminal and terminal accommodating chamber of FIG. 1 with the spacer in a pre-set position and the spacer lock arm in an insertion-blocking position.

Referring to FIGS. 2 and 3, a terminal 38 has an electrical contact portion 40 adjacent insert end 42 and an electrical wire connector 44 at outer end 46. An electrical wire 48 is connected to 44 in crimp style. An aperture 50 is formed adjacent contact portion 40. Terminal 38 also includes a shoulder 52 adjacent aperture 50 and a waterproofing rubber grommet 54 where wire 48 meets connector 44 at outer end 46.

As shown in FIG. 3, terminal accommodating chamber 6 includes an internal flexible retainer arm 56 extending from an inner wall 58. Retainer arm 56 is normally biased into an unflexed position (FIG. 7) partially blocking chamber 6. Retainer arm 56 has a concave free end 60 for hooking onto shoulder 52 of terminal 38 when the terminal is fully inserted in chamber 6.

In the position shown in FIGS. 2 and 3, spacer 2 is inserted to a pre-set position in connector 4, fitting around outer wall 14 of terminal accommodating chamber 6. In this pre-set position spacer 2 does not interfere with the insertion of terminal 38 into chamber 6. Terminal 38 deflects retainer arm 56 downwardly as it is inserted until the arm snaps back up into place behind shoulder 52 (FIG. 7).

In the pre-set position spacer 2 is prevented from falling out of connector 4 by a conventional latching pawl 17 in spacer housing 16. The latching pawl fits into a conventional recess in the side wall of chamber 6. In the present invention spacer 2 is also prevented from being prematurely moved from pre-set to the full-lock position. Stop 36 on top surface 30 of lock arm 18 abuts extension 12 from the upper wall of chamber 6 in the pre-set position to prevent spacer 2 from being accidentally pushed further inward to the full-lock position before a terminal is completely inserted in chamber 6.

Figure 4:
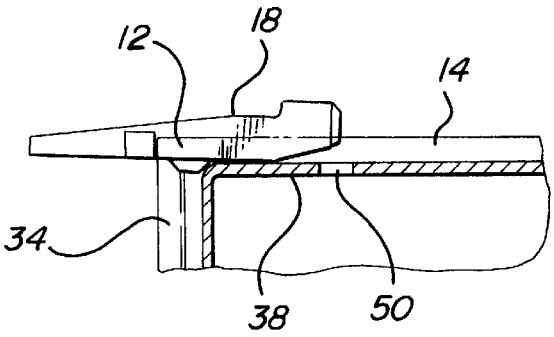
FIG. 4 is a partial cross-sectional top view of the terminal and chamber as the terminal is further inserted in the chamber and the spacer lock arm senses the terminal and begins to deflect.

In FIGS. 4 and 5, terminal 38 is inserted further into terminal accommodating chamber 6 and contacts the chamfered terminal-detecting and locking projection 34 on side wall 28 of lock arm 18. Lock arm 18 begins to pivot or deflect as it detects, via projection 34, the presence of terminal 38 within chamber 6. The chamfered corners on projection 34 provide for smooth insertion of terminal 38 and smooth deflection of lock arm 18. Insertion-blocking stop 36 on lock arm 18 begins to move out of contact with wall extension 12 in chamber 6.

Figure 6:
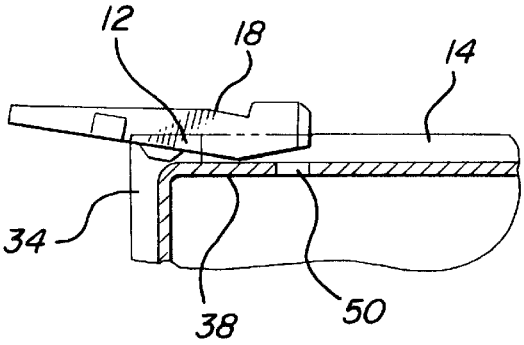
FIG. 6 is a partial cross-sectional top view of the terminal and chamber with the terminal fully inserted in the chamber and the spacer lock arm deflected out of the insertion-blocking position.

FIGS. 6 and 7 show terminal 38 fully inserted in chamber 6. Lock arm 18 is deflected with stop 36 disengaged from extension 12 in chamber 6. Now spacer 2 can be moved to the full-lock position.

Once terminal 38 is fully inserted in chamber 6, flexible retainer 56 snaps back to the unflexed position shown in FIG. 7. Free end 60 presses against terminal shoulder 52, holding terminal 38 in connector 4.

Figure 8:
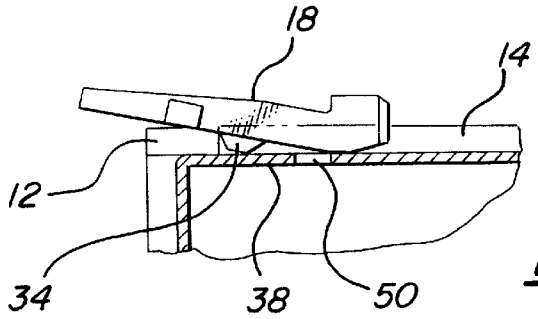
FIG. 8 is a partial cross-sectional top view of the terminal and chamber as the spacer is being inserted further into the connector housing from the pre-set position to the full-lock position.
Figure 9:
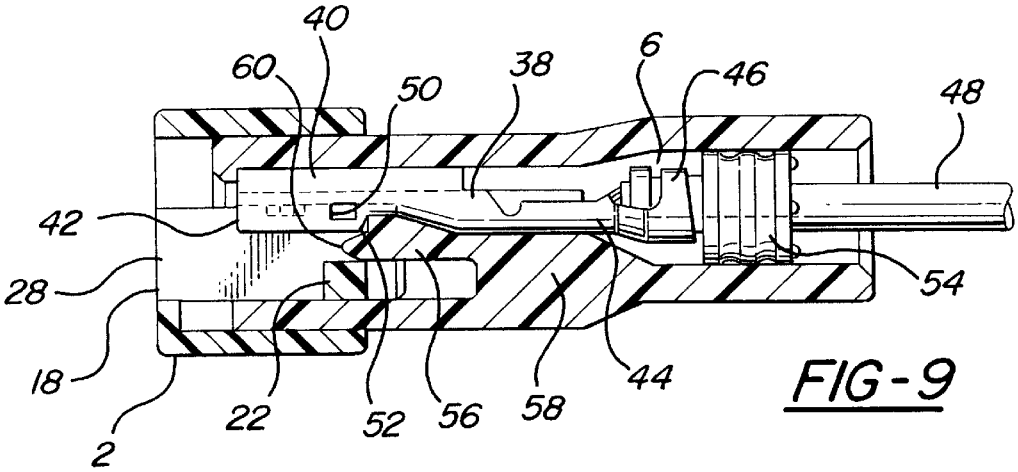
FIG. 9 is a cross-sectional side view (relative to FIG. 1) of the chamber and terminal with the spacer lock arm in the position shown in FIG. 8.

FIGS. 8 and 9 illustrate spacer 2 moving between the pre-set and full-lock positions. The chamfered terminal-locking projection 34 of lock arm 18 rides along terminal 38 as spacer 2 slides further into connector 4 along the outer wall 14 of chamber 6.

Figure 10:
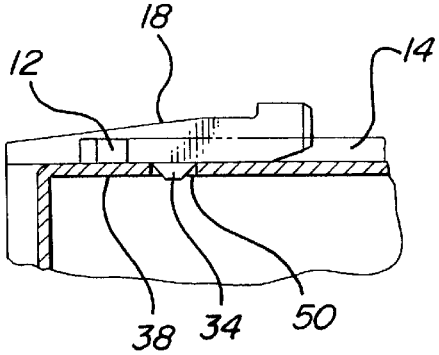
FIG. 10 is a partial cross-sectional top view of the terminal and chamber with the spacer lock arm in the full-lock position, locking the terminal in the chamber independently of the chamber's internal retainer arm; and, FIG. 11 is a cross-sectional side view (relative to FIG. 1) of the chamber and terminal with the spacer lock arm in the full-lock position shown in FIG. 10.
Figure 11:
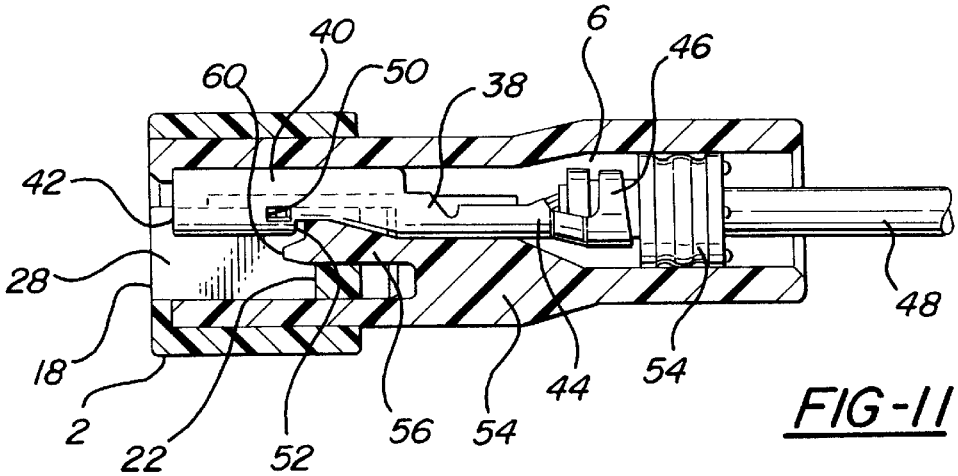

FIGS. 10 and 11 show spacer 2 arrived at the full-lock position. When chamfered terminal-locking projection 34 drops into aperture 50 in terminal 38, lock arm 18 returns to the at rest position. Terminal 38 is therefore securely held in terminal accommodating chamber 6 by projection 34 and by retainer arm 56 in chamber 6. Also, spacer cross arm 22 slides under retainer arm 56 and thereby prevents free end 60 of the retainer arm from moving out of contact with shoulder portion 52 of terminal 38.

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. A spacer for aiding in the retention of an electrical terminal in a terminal accommodating chamber in an electrical connector, the spacer comprising:

a housing having means for holding the spacer in a pre-set position in the connector;

a lock arm connected to the housing such that at least a portion of the lock arm can be deflected between an at rest position and a deflected position;

a stop on the lock arm for abutting a portion of the accommodating chamber when the lock arm is in the at rest position, thereby preventing the spacer from being moved from the pre-set position to a full-lock position;

means on the lock arm for contacting the terminal as the terminal is inserted into the chamber and allowing the terminal to deflect the lock arm to the deflected position;

whereby the spacer remains in the pre-set position in the connector while the terminal is inserted into the chamber and the lock arm is moved to the deflected position.

2. A spacer as defined in claim 1 wherein the terminal has an engagement aperture, and the terminal contacting means on the lock arm is sized and located such that the terminal contacting means is received into the engagement aperture when the terminal is fully inserted in the chamber and the spacer is moved from the pre-set position to a full-lock position.

3. A spacer as defined in claim 2, wherein the terminal contacting means on the lock arm is a projection on a side of the lock arm facing the terminal.

4. A spacer as defined in claim 3, wherein the projection is chamfered to enable smooth operation of the spacer.

5. A spacer as defined in claim 1, wherein the terminal accommodating chamber includes a retainer arm for securing the terminal in the chamber, and the spacer further comprises means for engaging the retainer arm and securing the retainer arm against the terminal in the chamber.

6. A spacer as defined in claim 5, wherein the means for ensuring that the retainer arm secures the terminal in the chamber is a cross arm on the spacer housing, the cross arm sliding beneath and pressing against the retainer arm when the spacer is in a full-lock position.

7. A spacer as defined in claim 1, wherein there are multiple chambers in the connector, and the spacer has a lock arm for each chamber.

8. A spacer with a terminal detection and locking function for an electrical connector, the spacer comprising:

a housing designed to be inserted into the connector and to be movable therein between a pre-set position and a full-lock position;

a lock arm connected to the housing such that it is inserted at least partway into a terminal accommodating chamber in the housing in the pre-set position;

insertion-blocking means on the lock arm for engaging a portion of the chamber and preventing insertion of the housing from the pre-set to the full-lock position;

means on the lock arm for detecting the presence of a terminal in the chamber and for causing the terminal to deflect the insertion-blocking means on the lock arm to permit the housing to be moved from pre-set to full-lock.

9. A spacer as defined in claim 8 wherein the lock arm comprises an elongated member with a side which faces the terminal when the spacer is inserted in the connector.

10. A spacer as defined in claim 9 wherein the means for detecting the terminal is on the side of the lock arm facing the terminal.

11. A spacer as defined in claim 10 wherein the means for detecting the terminal is a projection on the side of the lock arm facing the terminal.

12. A spacer as defined in claim 8 wherein the insertion-blocking means is a stop extending from a surface of the lock arm.

13. A spacer as defined in claim 8 wherein the terminal has an engagement aperture, and the terminal detecting means is sized and located on the lock arm such that the terminal detecting means is received into the engagement aperture when the terminal is fully inserted in the chamber and the housing is moved to the full-lock position.

14. A spacer as defined in claim 8 wherein the connector includes a retaining means for holding the terminal in the chamber when the terminal is fully inserted, and the spacer includes means for securing the retaining means against the terminal in the chamber.

15. A spacer as defined in claim 14, wherein the means for securing the retaining means is a cross-arm on which the lock arm is mounted for longitudinal deflection.

16. A spacer for detecting and locking an electrical terminal in a terminal accommodating chamber of an electrical connector, comprising:

a housing designed to be inserted into the connector and to be movable therein between a pre-set position and a full-lock position;

lock arm means on the housing for detecting the presence of the terminal in the chamber while the housing is in the pre-set position, for preventing the spacer from being moved from the pre-set position to the full-lock position until the terminal is detected, and for securing the spacer to the terminal when the terminal is detected in the chamber.

17. A spacer as defined in claim 16, wherein the lock arm means extends into the chamber when the spacer is inserted into the connector to the pre-set position.

18. A spacer as defined in claim 17, wherein the lock arm means engages a portion of the chamber in the pre-set position to prevent it from being moved to the full-lock position, and is designed to be deflected out of engagement with the portion of the chamber by the terminal when the terminal is inserted in the chamber.

19. A spacer as defined in claim 17, wherein the connector has two or more chambers and the spacer includes lock arm means for each chamber, such that the spacer cannot be moved from pre-set to full-lock without a terminal being fully inserted in each chamber.

* * * * *